United States Patent [19]

Wilson et al.

[11] Patent Number: 4,763,491

[45] Date of Patent: Aug. 16, 1988

[54] ACCESSORY FOR A DOMESTIC KNITTING MACHINE

[76] Inventors: Trevor E. Wilson; Joan A. M. Wilson, both of "Bargate", Parsonage Hill, Somerton, Somerset TA11 7PF, England

[21] Appl. No.: 2,711

[22] PCT Filed: Apr. 4, 1986

[86] PCT No.: PCT/GB86/00193

§ 371 Date: Dec. 10, 1986

§ 102(e) Date: Dec. 10, 1986

[87] PCT Pub. No.: WO86/06113

PCT Pub. Date: Oct. 23, 1986

[30] Foreign Application Priority Data

Apr. 10, 1985 [GB] United Kingdom ..... 8509214
Feb. 21, 1986 [GB] United Kingdom ..... 8604323

[51] Int. Cl.[4] ..... D04B 15/44
[52] U.S. Cl. ..... 66/146
[58] Field of Search ..... 66/146; 242/150 R, 150 M

[56] References Cited

U.S. PATENT DOCUMENTS

| | | | |
|---|---|---|---|
| 2,912,185 | 11/1959 | Vossen | 66/146 X |
| 3,146,969 | 9/1964 | Lindsey | 66/146 X |
| 4,398,681 | 8/1983 | Kupper | 242/150 R |
| 4,526,019 | 7/1985 | Betts et al. | 60/146 |
| 4,535,609 | 8/1985 | Goller et al. | 66/146 |

FOREIGN PATENT DOCUMENTS

| | | | |
|---|---|---|---|
| 3332146 | 3/1984 | Fed. Rep. of Germany | 60/146 |
| 560722 | 4/1952 | Italy | 66/146 |
| 107597 | 11/1924 | Switzerland | 66/146 |
| 2029943 | 2/1936 | United Kingdom . | |

*Primary Examiner*—Ronald Feldbaum
*Attorney, Agent, or Firm*—Roberts, Spiecens & Cohen

[57] ABSTRACT

A yarn brake of a plurality pairs of discs spaced apart along a straight rod of uniform non-circular section mounted in path of yarn as it is fed to the knitting needles.

8 Claims, 3 Drawing Sheets

ACCESSORY FOR A DOMESTIC KNITTING MACHINE

FIELD OF THE INVENTION

This invention relates to domestic knitting machines in which the usual needle bed carries a plurality of conventional latch needles and a carriage slidable lengthwise of the needle bed having on its underside a cam groove for successively engaging the butts of all the operative needles to be used for a given knitting operation and reciprocating them in accordance with the chosen pattern of the fabric to be produced. Such domestic knitting machines can be used in two modes:

(1) normal knitting, in which one or more yarns is fed to the carriage from a ball or cone of yarn at the rear of the machine via an overhead spring-loaded tensioning arm resiliently mounted on the top of a mast or pillar carried on the back of the needle bed;

(2) "Intarsia" or picture knitting in which a plurality of yarns, generally of equal thickness, and usually of diffferent colors, are drawn from their respective balls or cones at the front of the machine (usually placed on the floor) and laid in the open hooks of the appropriate needles which are then reciprocated by a special "intarsia" carriage. Before each traverse of the carriage adjacent yarns are crossed over, first one way then the other alternately, in order to avoid gaps or holes in the fabric at the boundaries of different colors.

In both modes, it is desirable to maintain a constant, relatively light, tension in the yarn as it is fed to the needle. In the first or normal mode of knitting, it is sometimes desired to knit a yarn which is a composite of a plurality of separate threads or filaments which differ as to color or nature e.g. a mixture of natural and artificial threads or filaments - which are coalesced into a single composite yarn as they are fed to the carriage. Prior to their coalescence, however, tensions in the several filaments are random, and differences can result in the "looping" of a slicker filament which in turn can lead to its being missed by a needle.

BACKGROUND ART

Hitherto, when knitting with a composite yarn composed of a plurality of different filaments with the machine set up for operation in mode (1) above, the only way of ensuring equality of length and tension among all the filaments when they reach the needles has been to twist them together first before feeding them as twisted yarn via the overhead springloaded tensioning arm at the head of the mast. But the only way of achieving such twisting is by bodily spinning all the supplies of the filaments - whether in the form of balls or cones or other kinds of package - as opposed to spinning the filaments after they have been drawn from stationary packages. When the number and variety of packages is large the mechanical problem of handling the whole assembly to be spun calls for precision engineering to combat problems of unbalanced rotating masses, and hence the cost, size and weight are serious limitations on the viability of the system for domestic knitting machines.

In the absence of such elaborate means for equalizing the lengths of and tensions in the component filaments of a composite yarn, the machine operator must constantly finger the separate filaments as they are fed down to the carriage in order to smooth out any individual slackness in the filaments, and the human factor involved can result in its own problems of inequality of tension.

In the case of intarsia knitting, it is common practice for the knitter to gather all the yarns together as they are drawn from their respective cones or balls and to hold them in the fingers of one hand while they are first laid by the other hand on the appropriate needles and crossed over in the usual way in order to preserve the integrity of the finished fabric at each boundary between different yarns, and then knitted by the carriage. By this system accurate control of the tension in each yarn is subject to human error, and irregularities are inevitable, even for experienced knitters. Moreover, this manual system of feed of the yarns to the needle does not eliminate the risk of tangling of the yarns, involving frequent stoppages for corrective action.

It is known to provide a plurality of weights adapted to be threaded onto each intarsia yarn before it is laid in the hooks of the respective needles. Each weight is frictionally suspended on the yarn below the needles so as to maintain a constant tension therein during the knitting action, and care must be exercised before each successive traverse of the carriage to locate each weight sufficiently far below the needles involved with the respective yarn to ensure that the weight, which rises with the yarn as it is drawn up to make the stitches, does not foul the needles while each row of stitches is being made. When using these weights, it is necessary to traverse the carriage slowly, both to enable the knitter to observe all the weights as they approach their respective needles, and also in order to ensure that the speed of formation of each stitch does not produce a jerk in the yarn which, by virtue of the inertia of the weight, would result in random variation in the tension of the yarn.

This system of weighting each yarn in an intarsia pattern allows the weights to swing freely from side to side while they rise towards the needle bed. Once a weight has begun to swing, it induces sympathetic motion in the length of yarn between its respective cone or ball and the weight, which is a prime cause of tangling with the aforesaid manual system of yarn control. The absence of any restraint on the freedom of the weights to move at random thus does nothing to solve the problem of tangling. On the other hand, it adds a new and tedious task for the knitter - that of threading all the weights onto their respective yarns before knitting can start. Each weight consists of a shuttle-like slug having a series of through holes along the length thereof through some or all of which the yarn must be threaded, depending on the thickness of the yarn, before finally being fed through an axial counterbore in the nose. A hook or needle is often required for this operation.

SUMMARY OF THE INVENTION

The present invention provides a yarn or thread brake to be interposed in the run of the yarn or thread from its ball or cone or other package to the needles, and consisting of a straight substantially rigid rod of uniform non-circular cross-section and a plurality of pairs of mating cheek plates or discs mounted thereon at intervals lengthwise of the rod. Each disc has a central hole of the same shape as the cross-section of the rod, the hole in each disc of each pair being a close enough fit to prevent rotation of the disc relative to the rod while allowing freedom of displacement of at least one disc axially of the rod. A light spring acts centrally on at least the said one disc of a pair to bias it into contact with its fellow.

Ideally, the discs of each pair have mutually freely interengageable guard or retainer formations which bridge the gap between the mating surfaces of the pair at a radial distance from the axis of the rod greater than the periphery of the hole in each disc by an amount sufficient to allow a yarn or filament to pass freely between the guard formation and the rod so as to prevent the yarn from being deflected out of engagement with the discs.

Preferably, the adjacent pairs of discs are spaced apart lengthwise of the rod by a rigid sleeve which is freely slidable on the rod and at least one end of which has an enlarged socket to accommodate a helical compression spring and provide an abutment for the spring at the inner end of the socket, the spring being free to bear against the disc adjacent the mouth of the socket so as to urge it into contact with its fellow.

Conveniently, the rod is fixed at each end in a bracket or arm whose other end is engageable with the machine frame or with a support structure for the machine so as to locate the rod in a desired position relative to the needle bed.

In this specification, the term "uniform noncircular cross section" defines cross sectional shapes of constant external dimensions throughout the length of a rod. It includes mainly circular shapes whose regular arcuate circumferences are interrupted by a rib or key; by a groove or keyway; by a flat, or by any other formation which breaks the uniformity of the circular curvature of the circumference. Whatever the contour of the cross-section of the rod, the hole in each disc is substantially identical to ensure that the disc does not rotate on the rod under friction from yarn running between opposite faces of each pair of discs.

BRIEF DESCRIPTION OF THE DRAWINGS

Practical embodiments of the invention will now be described, by way of illustration only thereof, with reference to the accompanying drawings in which.

DETAILED DESCRIPTION OF THE PREFERRED EMBODIMENTS

Figure 1:
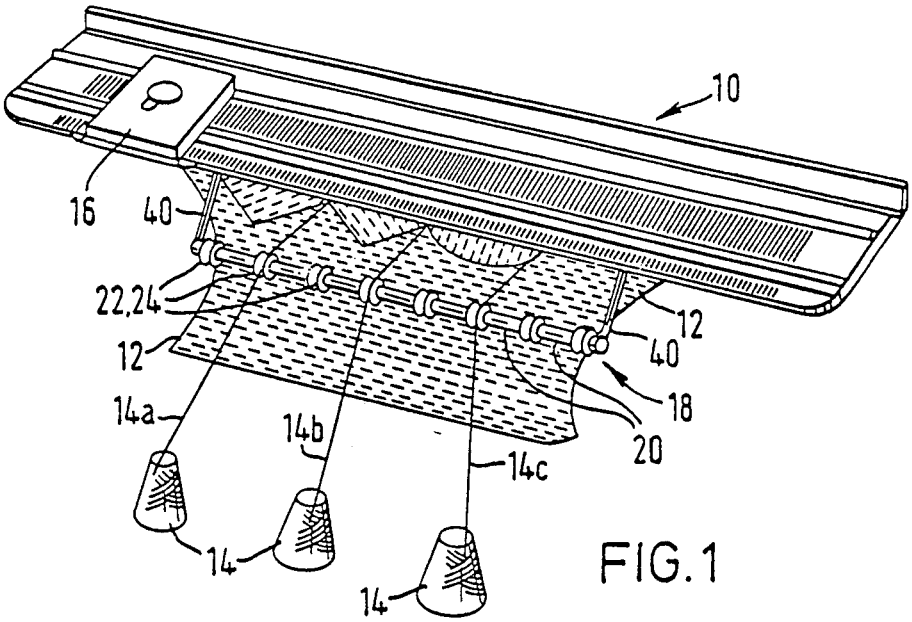
FIG. 1 is a perspective view of a typical domestic knitting machine set up for intarsia knitting and fitted with a yarn brake attachment according to the present invention.

Referring first to FIG. 1, a conventional domestic knitting machine 10 is shown producing an intarsia or picture fabric 12 from three different yarns 14*a*, 14*b* and 14*c*. No support structure for the machine 10 is shown. This may be an ordinary table or a specially designed frame. The choice is the user's. Each yarn is drawn from a respective cone 14 which is customarily placed on the floor in front of the machine 10. The carriage 16 is reciprocable, in the usual manner, lengthwise of the bed 10 to operate the required number of needles, and specially designed for intarsia knitting in that the cam (not shown) on its underside which engages the butts of all the operative needles is contoured so as first to project the hooks of the needles forward of the sinkers, without projecting the free tips of the open latches clear of the sinkers, so as to receive the several yarns 14*a*, 14*b*, 14*c* . . . as dictated by the pattern to be knitted; then to retract the needles to draw the hooks behind the sinkers in a stitch-forming action; and finally to project the hooks again between the sinkers to expose the open hooks for receiving the next runs of the several yarns, and so on. The knitted fabric 12 is thus suspended in front of the sinkers in the normal manner.

Figure 2:
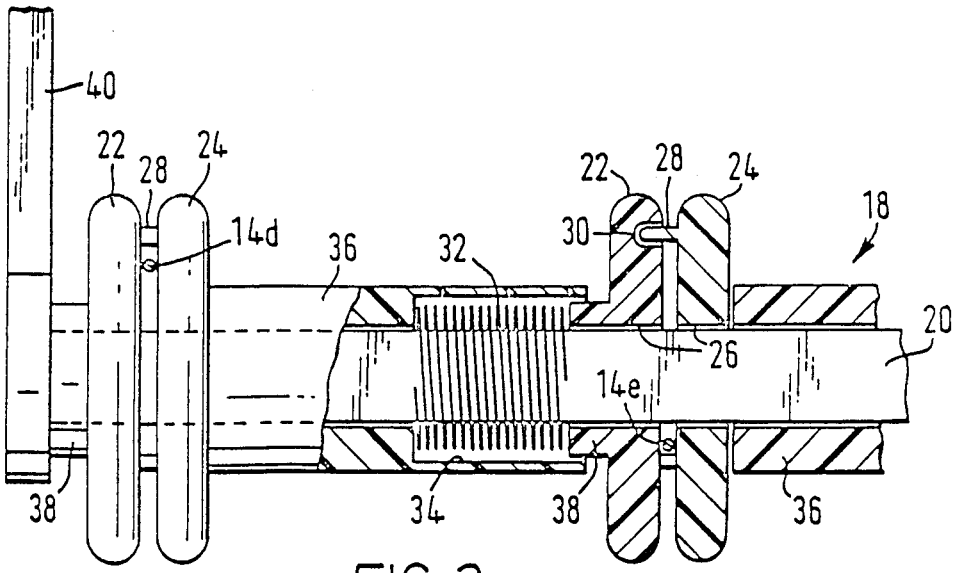
FIG. 2 is an enlarged side view, partly in section, of the attachment shown in FIG. 1.

As hitherto carried out, an intarsia knitting operation requires that the knitter should hold all the yarns 14*a*, 14*b*, 14*c* . . . in the fingers of one hand while the other is used to traverse the carriage 16 to and fro. This not only results in irregularity of tension in each yarn as well as between yarns during knitting, but also, by grouping the several yarns very close together in the hand, encourages tangling of the yarns both as they leave their respective cones 14 and between the fingers and the needles, especially at cross-over. It is these hazards which the present invention seeks to avoid by providing (see also FIGS. 2–6) a yarn brake, generally indicated at 18. This consists of a rod 20 of non-circular cross-section (in the example illustrated, the rod 20 is of square section) on which are mounted at regular intervals along its length a plurality of pairs of smoothfaced discs 22, 24. Each disc is centrally pierced by a hole 26 (FIGS. 3 and 4) of complementary shape to, but slightly larger than, the cross-section of the rod 20 so as to prevent rotation of the disc on the the rod while allowing relative axial displacement. The circumference of each disc is also well rounded to present a smooth, snag-free edge to each run of yarn between them. In FIG. 2, the yarn 14*d* is shown passing between the left hand pair of discs 22, 24 above the rod 20, and the yarn 14*e* is shown passing below the rod 20 between the adjacent pair of discs 22, 24. These two different yarn paths between the discs are illustrated to show the possibility of using a single pair of discs 22, 24 to tension and separate two yarns, thus tending to minimize or eliminate tangling even when the runs of two yarns are quite close together, as may be dictated by a particular intarsia pattern.

Figure 3:
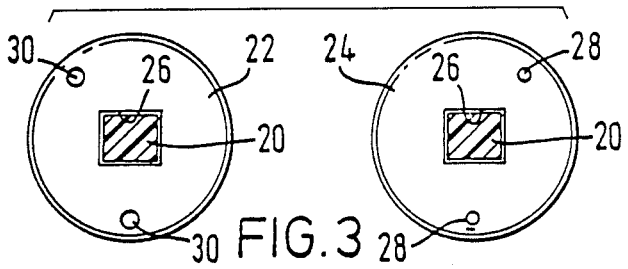
FIG. 3 is a plan view of one pair of mating discs as seen when the rod is cut on the medial plane between them and they are swung apart about an axis in that plane.
Figure 4:
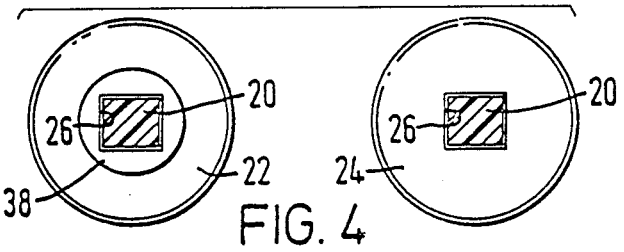
FIG. 4 is an underplan view of each disc of the pair seen in the same relationship as in FIG. 3.

FIG. 2 also shown each yarn 14*d*, 14*e* bearing against a retainer or guard formation 28 radially outward of the yarn with respect to the rod 20. This guard prevents yarn from being laterally displaced from between the discs 22, 24 of a pair. The righthand side of FIG. 2, which is in section through the axis of the rod 20, shows the retainer or guard 28 as a peg on the disc 24 of a pair which freely engages a coacting socket 30 in the other disc 22 of the pair. As seen in FIG. 3, two pegs 28 are carried by each disc 24, spaced angularly about the axis of the rod 20. The pegs 28 are fixed on the inward or mating face of each disc 24 and the sockets 30 are formed on the mating face of each disc 22. The angular spacing of the pegs 28 and sockets 30 is shown as less than 180°—i.e. the pegs 28 of each pair are not diametrically opposite each other. This arrangement is advantageous when the yarn brake 18 is mounted close in front of, say, a ribbing attachment (not shown) and facilitates the threading of a yarn between a pair of discs 22, 24 on the side of the rod 20 nearest the attachment by ensuring that the discs are orientated on the rod with one of the pegs 28 located, by virtue of the asymmetry of their mutual angular disposition, further in front of the plane of the attachment than it would with symmetrical disposition of the pegs, at the same time preserving separation between the yarns. Each disc 22, 24 is lightly spring-loaded into contact with its fellow in a pair by means of a helical compression spring 32 housed mainly in a socket 34 formed in one end of a tubular spacer 36 which slides freely on the rod 20. The inner end of the socket 34 provides an abutment for one end of the compression spring 32 the other end of which abuts the adjacent end of a hub or concentric collar 38 on each disc 22 which telescopes into the mouth of the socket 34 and is axially long enough to remain normally within that mouth so as to protect the compression spring 32 from being fouled at any time by yarn or any other external body. The axial length of each hub 38 must be sufficient to prevent disengagement from its respective socket 34 when all the other springs 32 in an array 18 are compressed to their minimum working lengths. The end of each spacer 36 opposite to the socket 34 bears against the disc 24 of an adjacent pair.

The discs 22, 24 are preferably synthetic resin plastic mouldings having smooth, polished mating faces, the guard formations 28, 30 and the hubs 38 being moulded integral with their respective discs. In one working arrangement, the springs 32 are of pre-galvanizing ed steel wire having a diameter of 0.716 mm. wound in 17 coils (active coils - 15) each of 18 mm. outside diameter with a free length of 27 mm. The spring rate is 0.03 N/mm (3.06 gm/mm), and the load at 19 mm is 0.24 N (25 gm). As described above, both discs 22,24 of each pair are free to slide on the rod 20, as also are the spacers 36, so that any one pair of discs 22, 24 can be separated far enough to allow yarn to be slipped over a guard peg 28 when it is to be introduced between the mating faces of the discs. In normal operation, all the guard pegs 28 remain in engagement with their complementary sockets 30.

Figure 7:
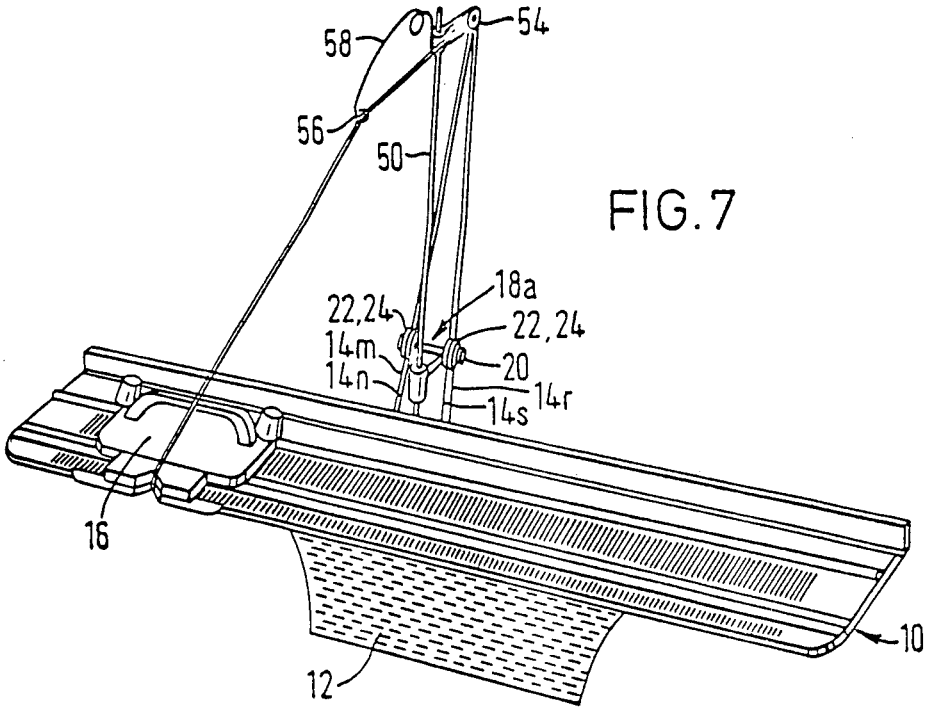
FIG. 7 is a view similar to FIG. 1 showing a brake according to the invention positioned for use when a number of separate threads or filaments are to be coalesced into a single yarn at the needles.
Figures 5, 6:
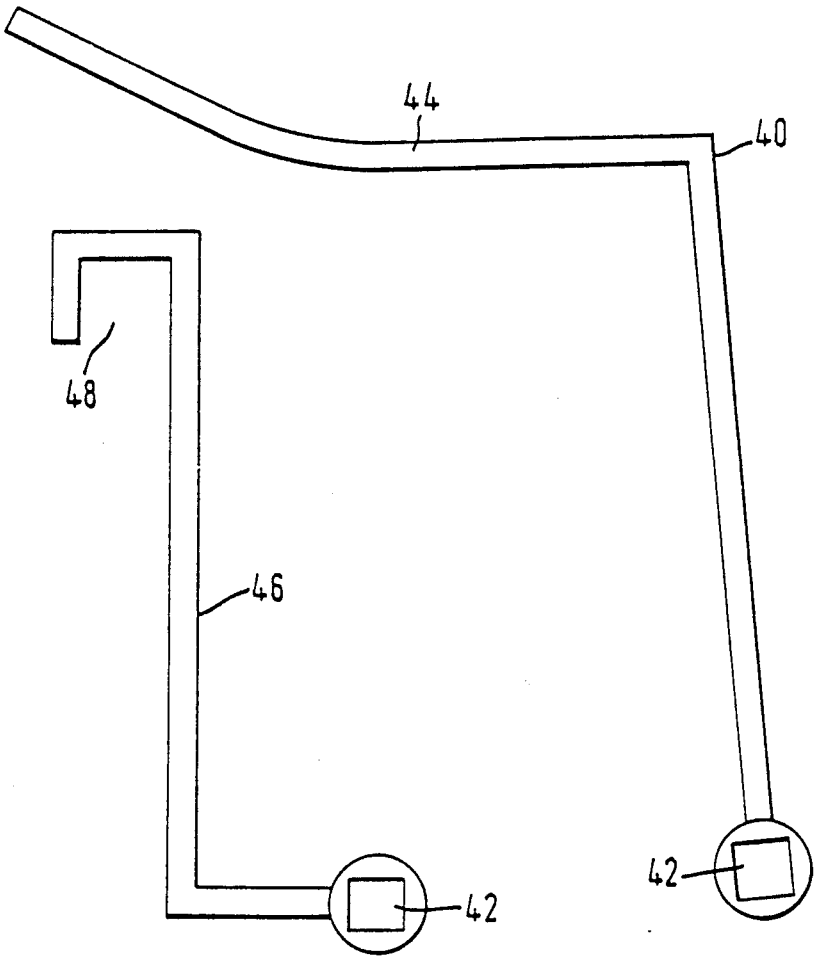
FIGS. 5 and 6 are side elevations of alternative forms of bracket for a yarn brake designed for use in intarsia knitting.

FIGS. 5 and 6 show two alternative shapes of bracket or arm for supporting the rod 20 during intarsia knitting. The cranked bracket 40 of FIG. 5 is that shown in the working position in FIG. 1. One extremity is enlarged to form a boss or socket 42 into which one end of the rod 20 can be inserted and locked - either permanently or, preferably, detachably. The other arm 44 of the bracket is of a length, and set at an angle, such that it can be either inserted into a socket provided for the purpose on the underside of the needle bed 10 or held by the weight of the machine on the surface of a table on which the machine is placed. The bracket 40 locates the rod 20 and the assembly of discs 22, 24 and spacers 36 at a level below the needles which is convenient for the operator to handle each yarn **14*a* . . . for laying in the hooks of the appropriate needles. Sometimes, however, a ribbing attachment is used with the needle bed 10. This is another needle bed which is suspended substantially vertically below the hooks of the needle bed 10. When such a ribber is fitted, the bracket 46 shown in FIG. 6 is used. The lower end of this bracket carries the same socket 42 for holding the rod 20, but its other end is formed as a square hook 48 of a shape and dimension to engage over the bed of the ribber. The rod 20 is then positioned adjacent the bottom edge of the ribber FIG. 7 shows a yarn brake 18*a* according to the invention fixed on the conventional mast 50 at the back of the needle bed 10. Two pairs of discs 22, 24 are mounted on a rod 20 carried in a bracket 52, and each pair is shown as engaging two strands or filaments 14*m*, 14*n* or 14*r*, 14*s* respectively, separation being achieved as shown in FIG. 2 by means of the guard pegs 28. These filaments may differ in color or in texture, or in physical composition, according to the requirements of the fabric to be knitted. For example, three filaments may be different colored wools and the fourth may be an artificial mono-filament. Each one is drawn from its respective cone or ball (not shown) which can be placed relatively closer together than usual because the steadying effect of the yarn brake 18*a* reduces the risk of tangling prior to their passage between the respective pairs of discs 22, 24. Thereafter, the strands or filaments are coalesced in their passage between the conventional adjustable-tension discs 54 (which are now set at zero tension) and through the feed loop or eye 56 of a spring-loaded or resilient feed arm 58 which automatically compensates for the changes in distance between the tension discs 54 and the carriage 16 as the latter is traversed along the needle bed 10**.

Generally, the pressure exerted by each pair of discs 22, 24 on a yarn passing between them is only sufficient to keep the yarn straight between the discs and the next point at which it is handled—the needles in FIG. 1 and the adjustable tensioner 54 in FIG. 7—so as to combat any tendency of yarns to tangle on this section of their path. The discs also fulfil the other useful function of allowing the cones, balls or reels in which the yarns are packed to be placed at smaller spacings than could be accommodated when the yarns are fed direct to the needles.

Although in the foregoing description both discs 22, 24 of a pair have been described as free to slide on the rod 20, it is to be understood that one disc of a pair may be fixed to provide an abutment for the respective spring 32. The rims of the discs can also be flared to facilitate the introduction of yarn between them. Nor need they be circular; they can be square or any other shape. In a still further modification, more than two discs or plates can be grouped together under the action of one spring; thus, three or more discs can be mounted side by side on the rod 20 to provide brakes for several yarns. In such a multiple disc assembly, an intermediate disc can be regarded as paired with the disc on either side.

It is to be understood in this specification that the terms "cheek plate" and "disc" mean a rigid article whose radial surfaces are flat, as opposed to being spherically or conically dished or convex.

What is claimed is:

1. The method of knitting a plurality of yarns at the same time on a domestic knitting machine wherein each yarn is fed from a source thereof to a plurality of conventional latch needles reciprocable in parallel grooves in a linear needle bed under the control of a carriage traversible along the bed comprising interposing in the path of each yarn from its source to the needles an array of spring-loaded yarn-restraining units having adjacent discs adapted to frictionally engage the yarn during the knitting operation;

mounting all of said yarn-restraining units coaxially end-to-end on a common rigid rectilinear support for axial movement along said support without rotation thereon;

positioning loading springs on said support between adjacent units to apply resilient biassing pressure in said units to frictionally engage the yarn traveling therepast and whereby the tensions in all said springs in said array are automatically equalized, and locating said common rectilinear support in a plane parallel to that of the needle bed so that all said yarn-restraining units are located at a common distance from the needles.

2. The method of feeding a plurality of yarns to the latch needles of a flat-bed domestic knitting machine comprising locating a straight rigid rod parallel to hook ends of latch needles of a flat bed domestic knitting machine;

assembling on said rod a plurality of yarn-restraining units each having a pair of coacting disc-like cheek plates nonrotatably mounted on said rod but freely slidable therealong;

applying resilient force from a compression spring loosely mounted on said rod to the check plates of adjacent units, and feeding each yarn to respective needles of said needle ed between a pair of coacting check plates.

3. A method of applying equal tensions to a plurality of yarns to be knitted at the same time on a domestic flatbed knitting machine comprising feeding each yarn through one of an array of spring-loaded yarn brake units;

assembling all said yarn brake units coaxially end-to-end on a common straight rigid support member with freedom of relative axial movement but without capability of relative rotation;

arranging a succession of loading springs on said support member, each bearing at its ends on yarn-engaging elements of adjacent units, and mounting said straight rigid support member with its axis parallel to the plane of a needle bed of the knitting machine.

4. A method as claimed in claim 3 comprising enclosing said springs within the yarn brake units.

5. A method as claimed in claim 3 wherein each yarn brake unit comprises a pair of adjacent cheek plates between which the respective yarn is fed, each spring directly applying resilient pressure to the cheek plate of an associated brake unit and to the cheek plate of an adjacent unit through the intermediary of a spacer.

6. A yarn brake attachment for a domestic flat-bed knitting machine in which a plurality of conventional latch needles are reciprocable in respective parallel grooves in a flat needle bed under the control of a carriage traversible along the needle bed comprising a straight rigid rod of non-circular cross-section;

means for mounting said rod with its axis in a plane parallel to and spaced from the needle bed, and a plurality of spring-loaded yarn brake units freely slidable on said rod, each including non-rotatable yarn-engaging disc elements on said rod and a loading spring applying resilient force to one of the disc elements of the associated unit and to one of the yarn-engaging disc elements of an adjacent unit.

7. A yarn brake attachment as claimed in claim 6 wherein each loading spring is a helical compression spring freely slidable on said rod and each yarn brake unit includes tubular spacer loosely mounted on said rod and having an open socket of enlarged internal diameter at one end to freely accomodate said helical loading spring and adapted to bear at its other end on the adjacent yearn-engaging disc element of an adjacent brake unit.

8. A yarn brake attachment as claimed in claim 6 wherein the yarn-engaging disc element of a yarn brake unit which lies adjacent said open socket of said tubular spacer includes an integral coaxial hub having an external diameter less than the internal diameter of said socket to permit freedom of entry of said hub into said socket and to provide an abutment for said helical compression spring.

* * * * *